US010799032B2

(12) United States Patent
Kang

(10) Patent No.: US 10,799,032 B2
(45) Date of Patent: Oct. 13, 2020

(54) AIR-CUSHION BLOCK STRUCTURE, AND MATTRESS INCLUDING AIR-CUSHION BLOCK STRUCTURE INSTALLED THEREIN

(71) Applicant: Nsbs Co., Ltd., Goyang-si, Gyeonggi-do (KR)

(72) Inventor: Seung Hyun Kang, Goyang-si (KR)

(73) Assignee: Nsbs Co., Ltd., Goyang-si, Gyeonggi-do (KR)

( * ) Notice: Subject to any disclaimer, the term of this patent is extended or adjusted under 35 U.S.C. 154(b) by 0 days.

(21) Appl. No.: 16/199,067

(22) Filed: Nov. 23, 2018

(65) Prior Publication Data

US 2019/0307258 A1 Oct. 10, 2019

(30) Foreign Application Priority Data

Apr. 10, 2018 (DE) ..... 10 2018 108 442

(51) Int. Cl.

| | |
|---|---|
| ***A47C 27/14*** | (2006.01) |
| ***A61G 5/10*** | (2006.01) |
| ***A47C 27/08*** | (2006.01) |
| ***A47C 7/14*** | (2006.01) |

(52) U.S. Cl.

CPC ..... *A47C 27/084* (2013.01); *A47C 7/14* (2013.01); *A47C 27/144* (2013.01); *A61G 5/1045* (2016.11); *A61G 5/1091* (2016.11)

(58) Field of Classification Search

CPC ..... A47C 7/18; A47C 27/144; A47C 27/148; A61G 5/1091; A61G 5/1043

See application file for complete search history.

(56) References Cited

U.S. PATENT DOCUMENTS

| | | | | | |
|---|---|---|---|---|---|
| 4,673,605 | A * | 6/1987 | Sias | A61G 7/05707 | 428/120 |
| 4,688,285 | A * | 8/1987 | Roberts | A61G 7/05723 | 5/630 |
| 4,866,800 | A * | 9/1989 | Bedford | A61G 5/1043 | 5/652.1 |
| 5,160,785 | A | 11/1992 | Davison, Jr. | | |
| 6,093,468 | A * | 7/2000 | Toms | A41D 13/0158 | 428/67 |

(Continued)

FOREIGN PATENT DOCUMENTS

| | | | | |
|---|---|---|---|---|
| AU | 2005234661 | A1 | 1/2007 | |
| CA | 3000143 | A1 * | 4/2017 | A47C 27/15 |

(Continued)

*Primary Examiner* — Timothy J Brindley

(74) *Attorney, Agent, or Firm* — Novick, Kim & Lee, PLLC; Jae Youn Kim; Jihun Kim

(57) ABSTRACT

Provided is an air-cushion block structure, and a mattress including the air-cushion block structure installed therein. The mattress of the present invention is provided with an air-cushion block structure which includes: an upper cushion having a first core hole vertically formed therein; and a lower cushion which has a second core hole vertically formed therein, and is disposed at a lower portion of the upper cushion. Accordingly, it is possible to stably transfer a weight of a user applied from an upper portion of the air-cushion block structure to a lower portion thereof, as well as, achieve a structure that stably supports the weight of the user by minimizing an occurrence of torsional deflection caused by the weight.

4 Claims, 4 Drawing Sheets

(56) References Cited

U.S. PATENT DOCUMENTS

| | | | | |
|---|---|---|---|---|
| 6,415,467 | B1 * | 7/2002 | Bretvin | A47C 4/54 5/710 |
| 6,739,008 | B1 | 5/2004 | Kindrick | |
| 6,777,062 | B2 * | 8/2004 | Skaja | B32B 3/26 428/143 |
| 7,574,760 | B2 * | 8/2009 | Foley | A47C 7/021 5/655.7 |
| 7,946,654 | B2 * | 5/2011 | Tsuber | A47C 4/54 297/452.21 |
| 8,904,584 | B2 * | 12/2014 | Sugano | B32B 7/04 5/652 |
| 8,910,334 | B2 * | 12/2014 | Lafleche | A61G 7/05715 5/713 |
| 9,096,158 | B2 * | 8/2015 | Herbst | B60N 2/5657 |
| 9,125,493 | B2 * | 9/2015 | Siekman | A47C 7/021 |
| 9,198,522 | B1 * | 12/2015 | Wei | A47C 27/081 |
| 9,352,531 | B2 * | 5/2016 | Berns | A41D 13/0506 |
| 9,635,897 | B2 * | 5/2017 | Prust | A47C 7/021 |
| 9,706,851 | B2 * | 7/2017 | Malkiewicz | A47C 27/20 |
| 2005/0151410 | A1 * | 7/2005 | Sprouse, II | A47C 7/14 297/452.41 |
| 2007/0277320 | A1 * | 12/2007 | Massmann | A47C 4/54 5/654 |
| 2010/0132120 | A1 * | 6/2010 | Koerlin | A61G 5/1043 5/654 |
| 2014/0230153 | A1 * | 8/2014 | Fraser | A61G 5/1043 5/654 |

FOREIGN PATENT DOCUMENTS

| | | | |
|---|---|---|---|
| JP | 1972041977 | Y | 12/1972 |
| JP | 3116064 | U | 11/2005 |

* cited by examiner

AIR-CUSHION BLOCK STRUCTURE, AND MATTRESS INCLUDING AIR-CUSHION BLOCK STRUCTURE INSTALLED THEREIN

CROSS-REFERENCE TO RELATED APPLICATION

Pursuant to 35 U.S.C. § 119(a), this application claims the benefit of earlier filing date and right of priority to Germany Patent Application No. 10 2018 108 442.0, filed on Apr. 10, 2018, in the German Patent and Trademark Office, the entire disclosure of which is incorporated herein by reference.

BACKGROUND OF THE INVENTION

1. Field of the Invention

The present invention relates to an air-cushion block structure and a mattress including the air-cushion block structure installed therein, and more particularly, to a mattress which is capable of stably transferring a weight of a user applied from an upper portion of an air-cushion block structure to a lower portion thereof, as well as, achieving a structure that stably supports the weight of the user by minimizing an occurrence of torsional deflection caused by the weight, and a mattress including the air-cushion block structure installed therein.

2. Description of the Related Art

In general, a wheelchair is mainly used by the elderly or the disabled with reduced mobility, and when they ride the wheelchair for a long time, bedsores, etc. may occur. To prevent an occurrence of the bedsores, various types of cushions for preventing a bedsore are installed on a seat of the wheelchair.

Such a cushion for preventing the bedsore includes a plurality of air-cushion blocks. A conventional air-cushion block known in the art is commonly manufactured in a form of a square block which is compressed by an external load and is restored to its original shape by sucking surrounding air when the external load is removed.

Meanwhile, when the conventional air-cushion block is compressed by the external load, a torsional deflection easily occurs therein, as well as, a load such as a weight of a user is supported over an entire surface of an upper surface of the air-cushion block. As a result, a body part of the user comes in contact with the upper surface of the air-cushion block in a relatively large contact area, thereby resulting in a decrease in an effect of preventing the bedsore.

SUMMARY OF THE INVENTION

Accordingly, it is an object of the present invention to provide a mattress which is capable of stably transferring a weight of a user applied from an upper portion of an air-cushion block structure to a lower portion thereof, as well as, achieving a structure that stably supports the weight of the user by minimizing an occurrence of torsional deflection caused by the weight, and a mattress including the air-cushion block structure installed therein.

To accomplish the above-described object, according to an aspect of the present invention, there is provided an air-cushion block structure including: an upper cushion having a first core hole vertically formed therein; and a lower cushion which has a second core hole vertically formed therein, and is disposed at a lower portion of the upper cushion.

Preferably, the upper cushion has a truncated conical shape (i.e., a frustum shape) whose cross section is increased toward the lower portion thereof, and the first core hole is formed at a central portion thereof.

In addition, the first core hole and the second core hole are communicated with each other in a state in which the upper cushion and the lower cushion are coupled with each other.

Further, the lower cushion has a plurality of supports formed on a lower surface thereof at a predetermined interval along a periphery of the second core hole.

Further, the plurality of supports have spaces defined therebetween by the predetermined intervals so that air flowing through the second core hole is horizontally discharged through the spaces.

Further, the upper surface of the upper cushion is formed with a plurality of load supporting points for dispersing and supporting a load such as a weight of a user applied to the upper cushion at positions vertically corresponding to the plurality of supports.

Furthermore, the upper cushion and the lower cushion are coupled so that the air is discharged through a gap formed therebetween when the weight of the user is applied to the upper cushion, so as to prevent twisting of the air-cushion block structure.

Meanwhile, according to another aspect of the present invention, there is provided a mattress including the air-cushion block structure installed therein.

According to the present invention, it is possible to stably transfer the weight of the user applied from the upper portion of the air-cushion block structure to the lower portion thereof, as well as, achieve a structure that stably supports the weight of the user by minimizing an occurrence of torsional deflection caused by the weight.

In addition, according to the present invention, since an area for supporting the weight of the user in the air-cushion block structure is formed in a relatively narrow range, the effect of preventing the bedsore may be increased.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
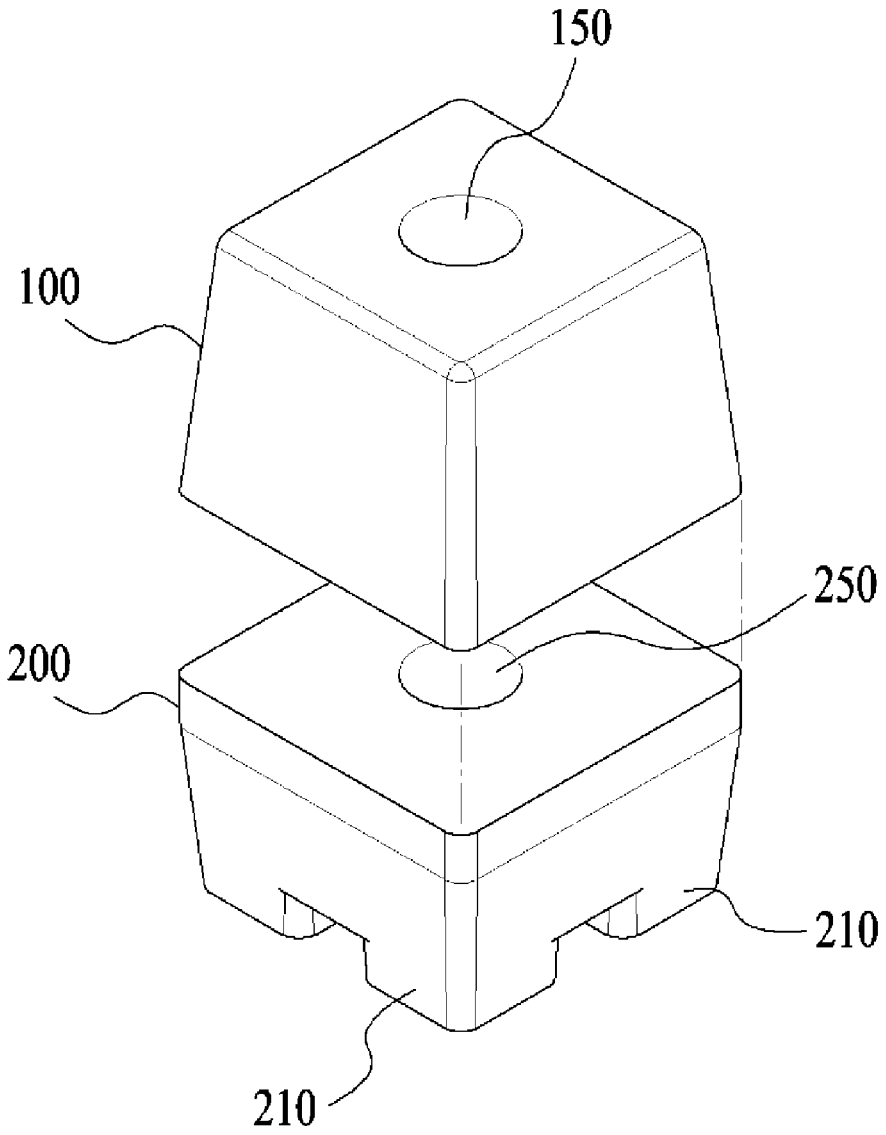
FIG. 1 is an exploded perspective view illustrating an air-cushion block structure according to an embodiment of the present invention.

Hereinafter, the present invention will be described with reference to the accompanying drawings in detail. Referring to the drawings, wherein like reference characters designate like or corresponding parts throughout the several views. In the embodiments of the present invention, the publicly known functions and configurations that are judged to be able to make the purport of the present invention unnecessarily obscure will not be described.

FIG. 1 is an exploded perspective view illustrating an air-cushion block structure according to an embodiment of the present invention. Referring to FIG. 1, the air-cushion block structure according to the embodiment of the present invention includes an upper cushion 100 and a lower cushion 200.

The upper cushion 100 may have a truncated conical shape whose cross section is increased toward a lower portion from an upper portion thereof, and may be formed in various truncated conical shapes such as a truncated circular cone shape, a truncated triangular pyramid shape, a truncated quadrangular pyramid shape, a truncated pentagonal pyramid shape, a truncated hexagonal pyramid shape and the like. However, in order to minimize a space defined between adjacent air-cushion block structures, it is preferable that the upper cushion has a truncated quadrangular pyramid shape as illustrated in FIG. 1, or a truncated hexagonal pyramid shape.

That is, since the upper cushion 100 has a truncated conical shape whose cross section is increased toward the lower portion from the upper portion thereof, a load applied to an upper surface of the upper cushion 100 is stably transferred to the lower portion. In addition, it is possible to minimize an occurrence of twisting in the upper cushion 100 caused by the load.

Meanwhile, the upper cushion 100 has a first core hole 150 vertically formed therein at a central portion thereof. Since the first core hole 150 is formed at the central portion of the upper cushion 100, a load applied to the upper surface of the upper cushion 100 may be evenly distributed along a periphery of the first core hole 150.

As described above, since a load such as a weight of a user applied to the upper cushion is uniformly distributed along the periphery of the first core hole 150, an occurrence of twisting in the upper cushion 100 caused by the weight of the user can be minimized.

In addition, the first core hole 150 is formed at the central portion of the upper cushion 100, and as a result, an area for supporting the weight of the user on the upper surface of the upper cushion 100 is formed in a relatively narrow range, and thereby more increasing an effect of preventing the bedsore.

Meanwhile, the lower cushion 200 is disposed with being connected to the lower portion of the upper cushion 100, and an upper surface of the lower cushion 200 preferably has the same shape and size as those of a lower surface of the upper cushion 100.

In embodying the present invention, the lower cushion 200 has the same truncated conical shape as the upper cushion 100, such that the lower cushion 200 may have a cross section so as to be increased toward the lower portion from the upper portion thereof.

However, by minimizing a separated distance between the upper cushions 100 in the air-cushion block structures installed adjacent to each other, it is possible to achieve a denser load supporting structure. For this end, it is preferable that the lower cushion 200 is formed in a shape of a column having a horizontal cross-section of a predetermined size.

That is, when the upper cushion 100 has a truncated conical shape such as a truncated circular cone shape, a truncated triangular pyramid shape, a truncated quadrangular pyramid shape, a truncated pentagonal pyramid shape, or a truncated hexagonal pyramid shape, the lower cushion 200, which is coupled to the lower surface of the upper cushion 100, is preferably formed in a shape of a cylinder, a triangular prism, a square column, a pentagonal column, or a hexagonal column corresponding thereto.

Meanwhile, the lower cushion 200 also has a second core hole 250 vertically formed therein. Herein, the first core hole 150 formed in the upper cushion 100 and the second core hole 250 formed in the lower cushion 200 have the same size and the same central position as each other. Accordingly, the first core hole 150 and the second core hole 250 are communicated with each other inside the air-cushion block structure, and as a result, a single core hole formed in a vertically continuous manner is defined in the air-cushion block structure.

Consequently, the air flowing downward in the first core hole 150 by the weight of the user applied to the upper surface of the upper cushion 100 passes through the second core hole 250, and is discharged to an outside from the lower central portion of the lower cushion 200 in a direction perpendicular to the ground.

As described above, a reaction force due to the air discharged from the lower portion of the lower cushion 200 in the direction perpendicular to the ground is applied to the central portion of the lower cushion 200, such that the air-cushion block structure according to the present invention may achieve a state of more stably supporting the load.

Figure 2:
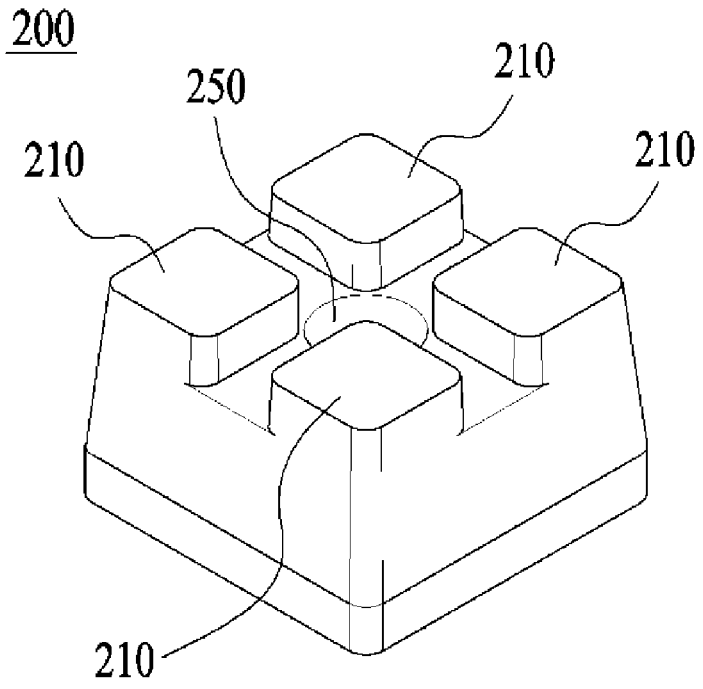
FIG. 2 is a perspective view illustrating a lower construction of a lower cushion of the air-cushion block structure illustrated in FIG. 1.

FIG. 2 is a perspective view illustrating a lower construction of the lower cushion 200 illustrated in FIG. 1. Referring to FIG. 2, the lower cushion 200 has a plurality of supports 210 formed on a lower surface thereof at a predetermined interval along a periphery of the second core hole 250.

The plurality of supports 210 are disposed in a circular shape on the lower surface of the lower cushion 200 and protrude from the lower surface of the lower cushion 200 with being spaced apart from each other. Therefore, the air flowing through the first core hole 150 and the second core hole 250 by the load applied to the upper surface of the air-cushion block structure is horizontally discharged from the lower portion of the lower cushion 200 through the spaces formed between the adjacent supports 210

Meanwhile, in embodying the present invention, the plurality of supports 210 are located at an outer periphery of the lower surface of the lower cushion 200, and a side face of the support 210 and a side face of the lower cushion 200 form a plane in a vertically continuous manner. Therefore, it is possible to minimize a reduction in the stability of the load supporting structure of the lower cushion 200 due to the space between the supports 210.

In addition, since the load applied to the upper surface of the upper cushion 100 is directly transferred to the ground by the supports 210, a reaction force caused by the air pressure due to the vertical load is applied to the support 210 from the ground. Therefore, load supporting points 110 for supporting the load such as a weight of the user are formed on each support 210.

Figure 3:
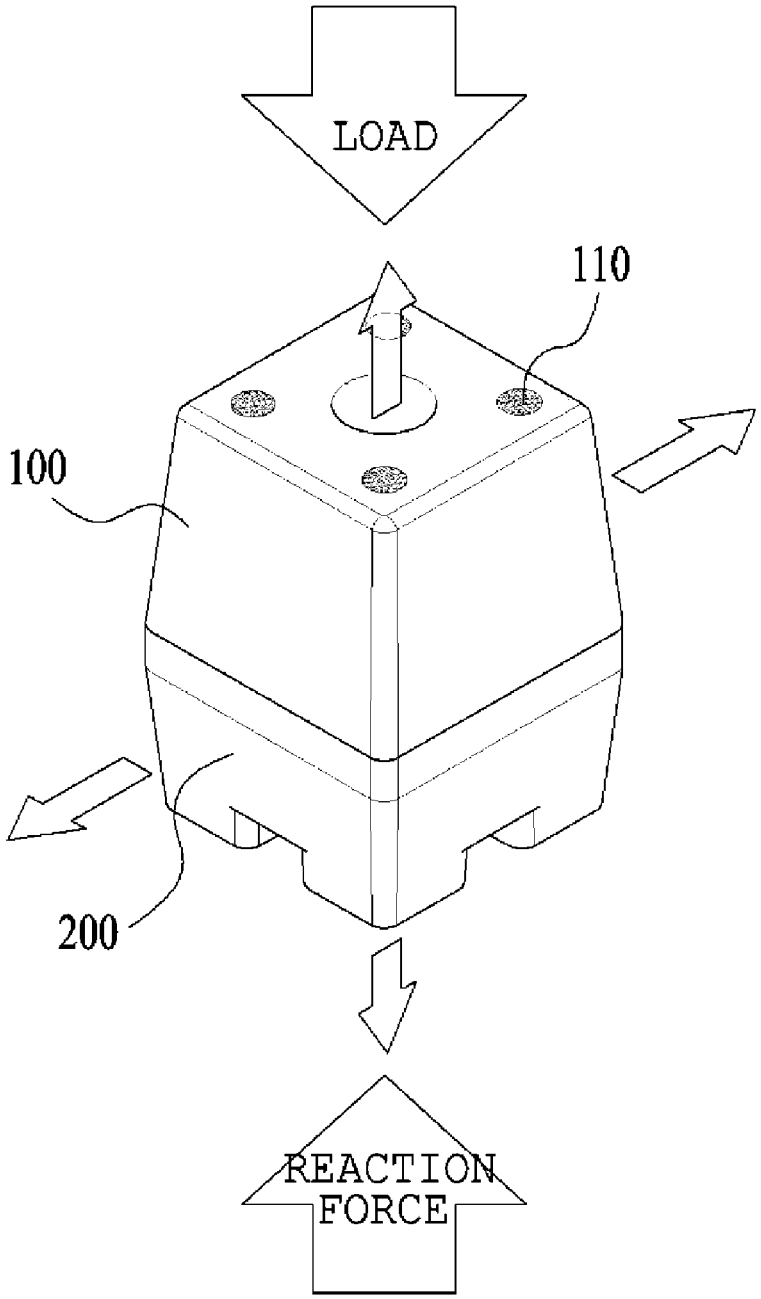
FIG. 3 is a conceptional perspective view for describing a principle of an operation of the air-cushion block structure according to the embodiment of the present invention.

Meanwhile, as illustrated in FIG. 3, a plurality of load supporting points 110 for dispersing and supporting the weight of the user applied to the upper cushion 100 are also formed on the upper surface of the upper cushion 100 at positions vertically corresponding to the plurality of supports 210.

That is, due to the first core hole 150 formed at the central portion of the upper cushion 100, the vertical load applied to the upper portion of the upper cushion 100 is uniformly dispersed along the periphery of the first core hole 150, as well as the plurality of load supporting points 110 are formed on the upper surface of the upper cushion 100 as illustrated in FIG. 3. Therefore, a structure of more stably supporting the load may be formed by the upper cushion 100.

Further, in the present invention, when installing the upper cushion 100 and the lower cushion 200 by connecting with each other in the vertical direction, the lower surface of the upper cushion 100 and the upper surface of the lower cushion 200 are configured so as to have a simple lamination structure while not bonding to each other. Due to such an installation structure, there is a fine gap between the lower surface of the upper cushion 100 and the upper surface of the lower cushion 200, which form a coupling surface between the upper cushion 100 and the lower cushion 200.

Accordingly, when the weight of the user is applied to the upper portion of the upper cushion 100, a part of the air flowing to the second core hole 250 through the first core hole 150 is horizontally discharged through the gap formed in the coupling portion between the upper cushion 100 and the lower cushion 200. Therefore, it is possible to prevent a phenomenon in which the air-cushion block structure is twisted when the weight of the user is excessively applied thereto.

As described above, according to the present invention, it is possible to achieve a structure in which the load is dispersed around the core holes 150 and 250 through the core holes 150 and 250 passing through the central portion of the air-cushion block structure, such that the maximum pressure at a point contacting with the skin of the user may be lowered.

In addition, according to the present invention, it is possible to achieve a function of buffering an interface pressure of the upper layer and the repulsive force of the bottom surface through the coupling portion between the upper cushion 100 and the lower cushion 200, and a function of serving as a passage through which the air horizontally flows.

Meanwhile, in embodying the present invention, the above-described air-cushion block structure according to the present invention may be continuously installed on a plane, thus to achieve a load supporting structure of a mattress for a cushion or a bed.

Figure 4:
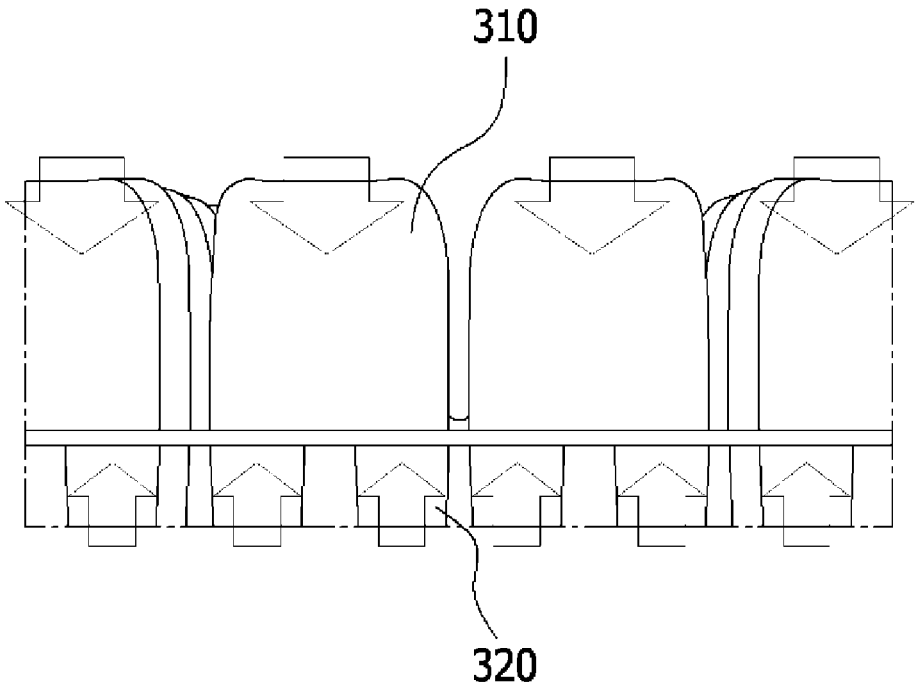
FIG. 4 is a view illustrating a structure of a mattress in which the air-cushion block structures according to the embodiment of the present invention are installed independently of one another.

FIG. 4 is a view illustrating a structure of a mattress in which the air-cushion block structures according to the embodiment of the present invention are installed independently of one another.

Referring to FIG. 4, a mattress according to an embodiment of the present invention includes an upper housing 310 and a lower housing 320.

The lower housing 320 has a plurality of lower pockets continuously formed therein having the same shape as the lower cushion 200 so as to house the lower cushions 200, respectively. Similarly, the upper housing 310 has a plurality of upper pockets continuously formed therein having the same shape as the upper cushion 100 so as to house the upper cushion 100, respectively.

Hereinafter, a process of manufacturing the mattress as illustrated in FIG. 4 will be described. First, the lower cushions 200 illustrated in FIG. 2 are housed and installed in the plurality of lower pockets provided in the lower housing 320 by a manufacturer.

Next, the upper cushions 100 are respectively housed in the plurality of upper pockets provided in the upper housing 310, and then the upper housing 310 is coupled to the upper portion of the lower housing 320 by the manufacturer. Thereby, the upper cushions 100 are laminated and installed on the upper portion of the lower cushion 200.

Thereafter, side edges of the upper housing 310 and the lower housing 320 are attached to each other by the manufacturer, thereby completing the mattress as illustrated in FIG. 4.

The terminology used herein is for the purpose of describing particular embodiments only and is not intended to limit the present invention thereto. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

While the present invention has been described with reference to the preferred embodiments and modified examples, the present invention is not limited to the above-described specific embodiments and the modified examples, and it will be understood by those skilled in the related art that various modifications and variations may be made therein without departing from the scope of the present invention as defined by the appended claims, as well as these modifications and variations should not be understood separately from the technical spirit and prospect of the present invention.

DESCRIPTION OF REFERENCE NUMERALS

100: Upper cushion
110: Supporting point
150: First core hole
200: Lower cushion
210: Support
250: Second core hole
310: Upper housing
320: Lower housing

What is claimed is:

1. An air-cushion block structure comprising:

an upper cushion having a first core hole vertically formed therein; and a lower cushion having a second core hole vertically formed therein, and disposed adjacent to a lower portion of the upper cushion, wherein the lower cushion has a lower surface which has a generally quadrangular shape and includes a plurality of supports disposed on the lower surface thereof at a same interval along a periphery of the second core hole, the plurality of supports being disposed on corner portions of the lower surface of the lower cushion, wherein each of the plurality of supports has at least two parallel side surfaces, and wherein respective two adjacent supports form a channel having a constant width such that air flowing through the second core hole is discharged in a horizontal direction along the lower surface of the lower cushion through the channel, wherein the plurality of supports are located adjacent to an outer periphery of the lower surface of the lower cushion, and a side surface of each of the plurality of supports and a side surface of the lower cushion form a continuous plane, and wherein a plurality of load supporting points are located on an upper surface of the upper cushion at positions vertically corresponding to the plurality of supports.

2. The air-cushion block structure according to claim 1, wherein the upper cushion has a truncated conical shape whose cross section is increased toward the lower portion from an upper portion thereof, and the first core hole is formed at a central portion thereof.

3. A mattress comprising the air-cushion block structure according to claim 1.

4. A mattress comprising the air-cushion block structure according to claim 2.

* * * * *